United States Patent [19]

Crooks

[11] 3,977,871

[45] Aug. 31, 1976

[54] ELECTROPHOTOGRAPHIC DEVELOPER WITH FIBERS OF POLYTETRAFLUOROETHYLENE

[75] Inventor: Walter Crooks, Los Gatos, Calif.

[73] Assignee: International Business Machines Corporation, Armonk, N.Y.

[22] Filed: Aug. 15, 1975

[21] Appl. No.: 604,988

[52] U.S. Cl. ..... 96/15 D; 427/14; 427/20; 427/21; 252/62.1 P

[51] Int. Cl.[2] ..... G03G 13/08; G03G 9/02

[58] Field of Search ..... 96/15 D; 252/62.1; 427/14, 20, 21

[56] References Cited

UNITED STATES PATENTS

| | | | |
|---|---|---|---|
| 2,297,691 | 10/1942 | Carlson | 96/1 R |
| 2,559,752 | 7/1951 | Berry | 252/357 X |
| 2,965,573 | 12/1960 | Gundlach | 96/15 D |
| 3,236,776 | 2/1966 | Tomanek | 252/62.1 |
| 3,838,064 | 9/1974 | Vogt | 252/384 |
| 3,838,092 | 9/1974 | Vogt et al. | 260/900 X |
| 3,850,631 | 11/1974 | Tamai | 96/1.5 |
| 3,873,355 | 3/1975 | Queener et al. | 252/62.1 |
| 3,900,588 | 8/1975 | Fisher | 427/14 X |

FOREIGN PATENTS OR APPLICATIONS

| | | |
|---|---|---|
| 1,233,869 | 6/1971 | United Kingdom |

*Primary Examiner*—Roland E. Martin, Jr.
*Attorney, Agent, or Firm*—Joseph G. Walsh

[57] ABSTRACT

The formation of toner film on the photoconductor in electrophotography is reduced by adding to the developer toner a small amount of fibrillatable polytetrafluoroethylene, and working the mixture until a random network of fibers of said polytetrafluoroethylene is formed.

4 Claims, No Drawings

ELECTROPHOTOGRAPHIC DEVELOPER WITH FIBERS OF POLYTETRAFLUOROETHYLENE

FIELD OF THE INVENTION

The present invention is concerned with the reduction of toner filming on the surface of photoconductors used in electrophotography. It has been found that such film is greatly reduced when the toner comprises a random network of polytetrafluoroethylene fibers.

PRIOR ART

My prior British Pat. No. 1,233,869, published June 3, 1971, describes a method for reducing toner filming of photoconductor surfaces by adding particles of polytetrafluoroethylene to the toner. The additive described in that patent is in the form of particles smaller in diameter than the toner particles to which it is added.

U.S. Pat. Nos. 3,838,064 and 3,838,092 describe compositions and processes used for dust control. A normally high dusting material is treated by the addition of a small amount of fibrillatable polytetrafluoroethylene and the mixture is then worked until a random network of fibers of polytetrafluoroethylene is formed. These patents describe two commercially available types of fibrillatable polytetrafluoroethylene resin. One type is a colloidal aqueous dispersion, and a second type, referred to as "fine powder," is obtained by coagulation of the dispersion. Both types work for the purposes of U.S Pat. Nos. 3,838,064 and 3,838,092. For the purposes of the present invention, however, only the "fine powder" type of fibrillatable polytetrafluoroethylene resin is operative. The reason for this is not known.

The preparation of the resins suitable for use in the present invention is described in U.S. Pat. No. 2,559,752. As mentioned above, only the "fine powder" type of resin, which may be obtained by coagulation of the colloidal dispersion, is suitable for use in the present invention.

SUMMARY OF THE INVENTION

In modern electrophotography, a latent electrostatic image is formed by first charging and then exposing an electrophotoconductive insulating surface to a light pattern. Toner is then used to develop the image. If the photoconductive surface is to be reusable, it must be kept clean of toner accumulation. The present invention represents a solution to this problem.

According to the present invention, there is incorporated into the toner a small amount of fibrillatable polytetrafluoroethylene resin. The amount may be anywhere from about 0.01% up to about 10% by weight of the toner. In general, from about 0.1% to about 2.0% by weight is preferred.

Most ordinary commercially available polytetrafluoroethylene resins are not fibrillatable. The preparation of fibrillatable polytetrafluoroethylene is described in detail in U.S. Pat. No. 2,559,752. Such material is available commercially from E. I. duPont and Company under the trademark "Teflon K, Type 10." Teflon K Type 10 brand of polytetrafluoroethylene is a free-flowing white powder having an average particle size of 500 microns. It should be noted that the typical toners used in electrophotography have a particle size in the range of from about 5 to about 20 microns. The present invention, therefore, differs from my prior British patent in that the prior British patent teaches the addition of polytetrafluoroethylene particles smaller than the toner particles. For the purposes of the present invention, however, the additives must be converted into the form of fibers, as is described in U.S. Pat. No. 3,838,064 mentioned above. This is accomplished by working the mixture at a temperature about 20% C. but lower than the decomposition temperature of the toner and of the polytetrafluoroethylene resin until a random network of fibers of said polytetrafluoroethylene resin is formed.

The present invention is suitable for use with any of the toner compositions used in electrophotography. Typically, such compositions are resins, for example, one or more thermoplastic resin materials such as polystyrene, polymethylstyrene, polybutylmethacrylate, polyvinyl butyral, epoxy resins, rosin, rosin esters, and the like, mixed with about 8% of a coloring pigment or a dye, for example, carbon black or a nigrosine dye.

The present invention is suitable for use with any type of photoconductive surface such as is used in commercial electrophotography. It is, for example, suitable for use with organic photoconductors, such as the one-to-one molar ratio of polyvinyl carbazole and trinitrofluorenone. It is also suitable for use with inorganic photoconductors such as vitreous selenium and alloys thereof.

The following Example is given solely for purposes of illustration and is not to be considered a limitation on the invention, many variations of which are possible without departing from the spirit or scope thereof.

EXAMPLE 1

70 grams of Hunt Graph-O-Print toner (a pigmented poly-styrene-n-butyl methacrylate copolymer manufactured by P. A. Hunt Chemical Co.) was placed inside a Waring blender and to this was added 2.1 grams (3% by weight) of Teflon K Particle Control Additive Type 10. Dispersion was performed by turning on the blender at full rpm for 5 secs and then turning it off for 10 secs. This operation was repeated 20 times. After mixing, the toner and additive were cycled with an organic photoconductive insulating film containing 8 percent by weight of a polyester adhesive known as 49000 Mylar adhesive, a brand of 60/40 ethylene telephthalate/isophthalate copolymer from DuPont. The organic electrophotoconductive insulating film comprised a one-to-one molar ratio of polymerized vinylcarbazole and 2,4,7-trinitro-9-fluorenone.

The cycling was carried out in duplicate on a laboratory toner-cycling machine which simulated copying machine cleaning conditions. The toner and additive mixture were continually rubbed against the organic electrophotoconductive insulating film with rabbits fur, a material used in the cleaning brushes for electrophotoconductive insulating films. After 10,000 cycles the film was examined to determine the degree of filming which has occurred. It was next compared with a control, which had been cycled for the same number of cycles with toner without the Teflon K and with rabbits fur. The control was filmed heavily, whereas no toner filming was evident with the tests containing the Teflon K additive and toner.

Microscopic examination of the toner containing the Teflon K additive showed it to be distributed in a fibrous form in the toner. A further observation was that the Teflon K was deposited on the rabbits fur indicating that this additive forms a network around the brush fibers.

What is claimed is:

1. In an electrophotographic process wherein an electrostatic image is made visible by contacting the surface bearing said image with finally divided toner particles of thermoplastic resin containing coloring material, the improvement according to which toner filming of the image bearing surface is reduced by incorporating in the toner in an amount from about 0.01% up to 10% by weight of the toner an additive of fine powder type polytetrafluoroethylene dispersed throughout said toner in the form of a random network of fibers, said fine powder type polytetrafluoroethylene having been obtained by coagulation of a colloidal acqueous dispersion.

2. A process as claimed in claim 1 wherein the amount of polytetrafluoroethylene is about 1.5%.

3. A developer composition for electrophotography comprising finely divided toner particles of thermoplastic resin containing coloring matter, and, in an amount from about 0.01% up to 10% by weight of the toner, a random network of fibers of fine powder type polytetrafluoroethylene dispersed throughout said toner, said fine powder type polytetrafluoroethylene having been obtained by coagulation of a colloidal aqueous dispersion.

4. A developer composition as claimed in claim 1 wherein the polytetrafluoroethylene is present in approximately 1.5% by weight of the toner.

* * * * *